US009756966B2

(12) United States Patent
Weltmeyer

(10) Patent No.: US 9,756,966 B2
(45) Date of Patent: Sep. 12, 2017

(54) APPARATUS AND METHOD FOR HORIZONTAL STORAGE AND DISPLAY OF SHOES

(71) Applicant: Roy Kenneth Weltmeyer, Edgewater, FL (US)

(72) Inventor: Roy Kenneth Weltmeyer, Edgewater, FL (US)

( * ) Notice: Subject to any disclaimer, the term of this patent is extended or adjusted under 35 U.S.C. 154(b) by 0 days.

(21) Appl. No.: 15/222,045

(22) Filed: Jul. 28, 2016

(65) Prior Publication Data

US 2017/0035228 A1 Feb. 9, 2017

Related U.S. Application Data

(60) Provisional application No. 62/282,556, filed on Aug. 5, 2015.

(51) Int. Cl.
*A47F 5/08* (2006.01)
*A47F 7/08* (2006.01)

(52) U.S. Cl.
CPC ..... *A47F 7/08* (2013.01); *A47F 5/0823* (2013.01)

(58) Field of Classification Search
CPC ..... A47F 5/0823; A47F 7/08; A47G 25/00; A47G 25/005; A47G 25/0607; E05B 69/003
See application file for complete search history.

(56) References Cited

U.S. PATENT DOCUMENTS 750,634 A * 1/1904 Gable ..... A47G 25/10 211/30
908,320 A * 12/1908 Page ..... A47G 25/10 211/32
908,392 A 12/1908 Casteel
1,646,068 A * 10/1927 Rosner ..... A47K 10/14 211/16
1,710,731 A 4/1929 Hawkins
2,583,563 A * 1/1952 Habel ..... A47L 23/20 211/32
3,104,013 A * 9/1963 Fisk ..... A47F 7/08 211/37
3,409,260 A * 11/1968 Bleed ..... A47F 5/0823 248/220.22
3,635,353 A 1/1972 Matsubara
3,921,812 A * 11/1975 Hamrock ..... A47F 5/0823 211/70.6
4,319,730 A * 3/1982 Thalenfeld ..... A47F 5/0823 248/220.41

(Continued)

FOREIGN PATENT DOCUMENTS

DE 916670 C * 8/1954 ..... A47G 25/0607
FR 1070961 A * 8/1954 ..... A47G 25/0607
FR 1278063 A * 12/1961 ..... A47G 25/0607

*Primary Examiner* — Joshua Rodden

(57) ABSTRACT

The invention disclosed herein provides a device and method of storing shoes that allows for immediate accessibility, ready visibility and reduction of clutter. Shoes can be organized, categorized, accessed and stored for instant use. Also, the device and method presented allow for commercial display of shoes in shops, stores or outlets that offer shoes for sale. Balls bearing user-selected and positioned designs or indicia at the end of hangars allow the user to readily change, replace, expand, and reposition shoes for visually appealing inspection easily and instantly.

4 Claims, 6 Drawing Sheets

(56) References Cited

U.S. PATENT DOCUMENTS

| | | | | | |
|---|---|---|---|---|---|
| 4,413,379 | A | * | 11/1983 | Evans | A47G 25/0607 24/3.11 |
| 4,967,913 | A | | 11/1990 | Bayer | |
| 5,065,871 | A | * | 11/1991 | Chan | A43D 3/1491 12/128 B |
| 5,269,408 | A | | 12/1993 | Otis | |
| 5,468,063 | A | | 11/1995 | Simonek | |
| 5,490,650 | A | | 2/1996 | Pendergrass | |
| 5,984,250 | A | * | 11/1999 | Connor | A47G 25/0607 24/599.1 |
| D490,695 | S | * | 6/2004 | DeBiasio, Jr. | D8/373 |
| 2010/0193451 | A1 | * | 8/2010 | Levine | A47F 5/04 211/37 |

* cited by examiner

APPARATUS AND METHOD FOR HORIZONTAL STORAGE AND DISPLAY OF SHOES

CROSS-REFERENCE TO RELATED APPLICATIONS

This application claims priority to U.S. patent application Ser. No. 62/282,556, filed Aug. 5, 2015.

STATEMENT REGARDING FEDERALLY SPONSORED RESEARCH/DEVELOPMENT

Not applicable.

BACKGROUND

The present invention relates generally to shoe storage and display, and more specifically to a device and method to allow easy storage, access, organization and display of shoes in a horizontal disposition so that they can be easily viewed, removed, and returned or replaced.

Storage is a persistent problem for those living in apartments, condos and houses with limited closet space. Clothing and shoes must be stored in a manner that provides visibility and access in order to be used. Today, people generally have a variety of pairs of shoes for various activities, including golf shoes, running and walking shoes, casual or dress shoes, etc. These are often kept on the floor of a closet or other storage space, which can become cluttered, piled up, or otherwise difficult to see and access. The invention disclosed herein addresses this by providing a device and method of storing shoes that allows for immediate accessibility, ready visibility and reduction of clutter. Shoes can be organized and stored for instant use.

Another intended use for the device and method disclosed herein is for display in shops, stores or outlets that offer shoes for sale. Displaying shoes is typically done by mounting or placing shoes on flat shelves along a display wall. This requires regular dusting of the shelves, which can become cracked or warped with time. They also require the shoes to be positioned along the wall lengthwise, resulting in space of at least the length of the shoe required for customer visualization of each shoe or pair. With the present invention, shoes are hung on hangers facing outwards, or at a forty-five (45) degree from the mounting wall. In this way, less space is required to display each shoe, resulting in increased capacity for more shoes on display. This benefits both the buyer and the seller, in that a greater variety can be presented in a smaller space.

DESCRIPTION OF RELATED ART

This invention is unique in that it offers the user a single device that can be used for both storage and display. It can be made and used with an infinite number of design elements, which could organize shoes based on their type or use. The grip ball component, which allows for hanging upon, presses and attaches the shoe to the storeboard, and is shaped and designed to incorporate colors, designs and sports indicia including but not limited to golf, tennis, basketball, football, baseball, cricket, bowling or other sports balls bearing team colors or logos.

Unlike existing shoe storage and display methods in the prior art, this invention allows the user to readily change, replace, expand, and reposition shoes for visual appeal easily and instantly. With the invention disclosed herein, the user can view and access shoes for immediate use or inspection.

Pegboard, slatboard and slatgrid wall mounting surfaces are not new. Perforated hardboard has been used for mounting and display of a range of products, ranging from tools to sporting equipment to clothing to food items, in both retail and home settings. These typically involve a rigid surface with pre-drilled holes or slats, which accept pegs or hooks to support items stored or displayed thereon. The present invention is specifically applicable to the display and storage of shoes, as the ball at the end of the hanger is used to support the shoe that is hung upon it as well as press against the back of the shoe, where the heel of the wearer is typically positioned when the shoe is worn. Also, in one embodiment of the invention, a double ended hanger allows the user to place pairs of shoes together, and reposition them anywhere on the storeboard surface. In this way, shoes can be rearranged based on trends, wearing priority, or other personal or commercial preference.

This invention is also further distinguished by the orientation it allows for placement of the shoes upon the storeboard. Existing devices and methods orient the shoe with one or another side long side placed along the wall. By placing the shoe at a forty-five (45) degree angle from the storeboard with the shoe pressed against it, the shoe is oriented outward, so that the toe is presented. This allows for multiple advantages, including making the shoe underside visible, occupying less space, and optimizing viewing of the entire shoe.

Another advantage of this invention over existing art is that the grip balls can be ornamented, shaped, colored and textured to resemble sports balls or other specialty designs. In this way, specific shoes can be ordered or organized based on the shoe type. For example, golf shoes would be hung on hangers with golf ball design balls. Tennis shoes would similarly be hung on hangers with balls which are replicas of tennis balls. Dress or fancy shoes could be put on crystal or other decorative grip ball hangers. One skilled in the art would appreciate that any type of sport or specialty design consistent with the use of a shoe could be used and be consistent with the disclosure presented herein. This would be especially beneficial to commercial shoe sellers, who could appeal to patrons with specific team logos, game indicia or other design elements presently in fashion.

SUMMARY

It is desirable to have a changeable storage or display system for shoes that is assembled in any configuration preferred by the user, made by easily connecting complimentary components. The preferred embodiment comprises a pegboard or slatboard "storeboard", with complimentary hangers removably inserted into the holes or slats thereon. The hangers are adapted to the storeboard by virtue of the shape of the hanger and the attached ball, referred to as a grip ball on its end. The grip ball is larger than, and attached either permanently or removably affixed onto the end of the hanger stem, which is hung perpendicular to the wall or surface the shoe is hung or displayed on. It is sized to fit inside of a shoe, and is decorated, ornamented or designed with sports or other specialty insignia or indicia The shoe can rest upon the grip ball, or the ball can be manipulated up or down to releaseably press against the portion of the shoe that covers the back of the wearer's heel. By pressing this portion of the shoe against the storeboard the shoe will be more securely anchored in place for sturdy storage and display.

It is further desirable to provide a storage and display for shoes assembled by the user through which a user can sort or arrange shoes based on individual use and preference. In the present invention, each hanger and its corresponding grip ball can be individually selected, arranged and directly applied to the storeboard surface by the user. New component hangers can be added, collected, and changed to comport with trending styles and preferences.

As a display, the present invention offers a way to provide colors, texture, artwork or sports elements. It can be used with standard pegboard, slatgrid or slatboard backing (the storeboard), where hangers are connected to the storeboard by pressing or inserting through holes or slats. As the hangers are connected to the storeboard, an easily visible organized display is constructed upon which shoes can be safely and artfully stored.

In a one embodiment, the design balls and hanger exhibit a slight spring when pressed and released, which holds the shoe in place with just enough pressure to keep it steady; when the ball is released or pressed away, the shoe can easily be removed.

The present invention utilizes existing pegboard, slatboard or slatgrid panels, collectively called herein storeboards. Individual hangers are connected to grip balls that physically support and may also press the shoe against the storeboard, which allows the user to connect, extend, and infinitely expand the storage and display surface in all directions.

REFERENCE NUMERALS USED IN THE DRAWINGS

10. grip ball
20. pegboard hanger stern
30. pegboard hanger insert
40. shoe illustration shown in use with apparatus
50. slatboard hanger insert
60. slatboard hanger stem
70. storeboard

FIGURES OF THE DRAWINGS:

These and other features, aspects and advantages of the present invention will become better understood with regard to the following description, claims and accompanying drawings where:

FIG. 1 (*b*) shows a view from the top of the invention in a pegboard embodiment.

FIG. 1 (*c*) shows a view from the bottom of the invention in a pegboard embodiment.

FIG. 1 (*d*) shows a side of the invention in a pegboard embodiment.

DETAILED DESCRIPTION

The invention described herein contemplates an apparatus and method for the storage and display of shoes. It provides for horizontal, toe-facing orientation to optimize space and viewing capacity for the user. The hanger includes an ornamented grip ball, which supports the shoe both by allowing the shoe to hang from it and by pressing against the portion of the shoe occupied by the wearer's foot when the shoe is hung upon it.

FIGS. 1(*a-d*) illustrate the invention in a pegboard embodiment. The invention in the pegboard embodiment comprises a pegboard hanger, capable of insertion into standard commercially available pegboard. The hanger is composed of a pegboard grip ball 10 at the end of a pegboard hanger stem 20 and a pegboard hanger insert 30 at the opposite end of the hanger from the grip ball 10. The drawings in FIGS. 1 (*a-d*) show a golf-type grip ball design. This invention contemplates a variety of grip ball designs, representing sports or other specific decorative designs consistent with the types of shoes hung on or supported by the grip balls 1. In FIG. 1(*a*), the perspective view of the pegboard embodiment with the golf ball grip ball is presented. FIG. 1(*b*) shows the invention viewed from the top, also showing the golf ball style grip ball. FIG. 1(*c*) shows the same embodiment as FIG. 1(*b*) from the bottom of the invention. FIG. 1(*d*) shows the invention from the side, again illustrating the golf ball grip ball design. In this figure, the pegboard hanger stem 20 is shown; the stem comprises an angle or directional return which directs the hanger back towards the storeboard, placing the grip ball in proximity to the storeboard to more securely position it.

Figure 1A:
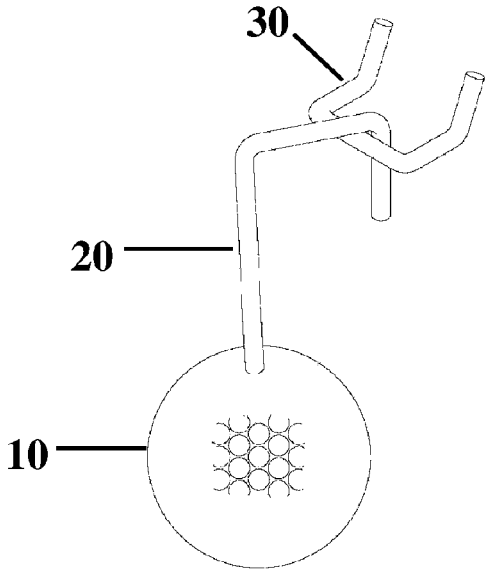
FIG. 1 (*a*) shows a perspective view of the invention in a pegboard embodiment.
Figure 1B:
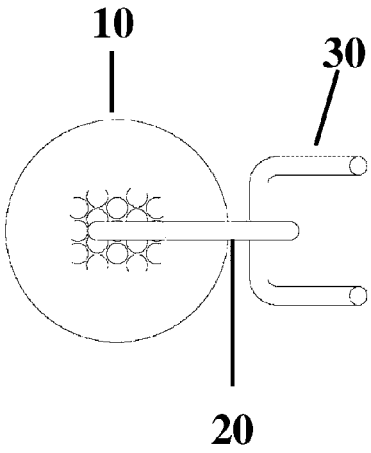
Figure 1C:
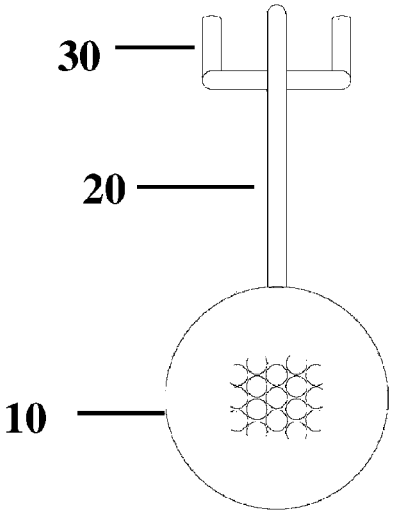
Figure 1D:
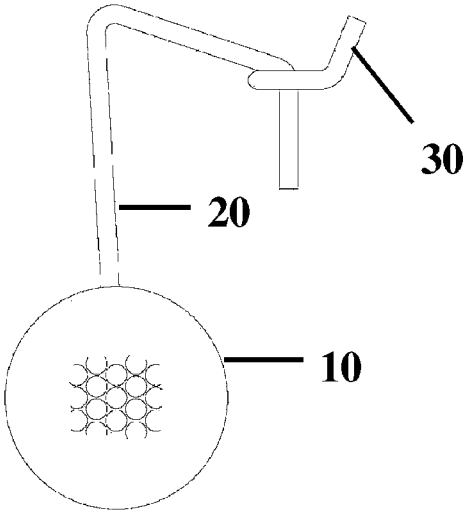
Figure 2:
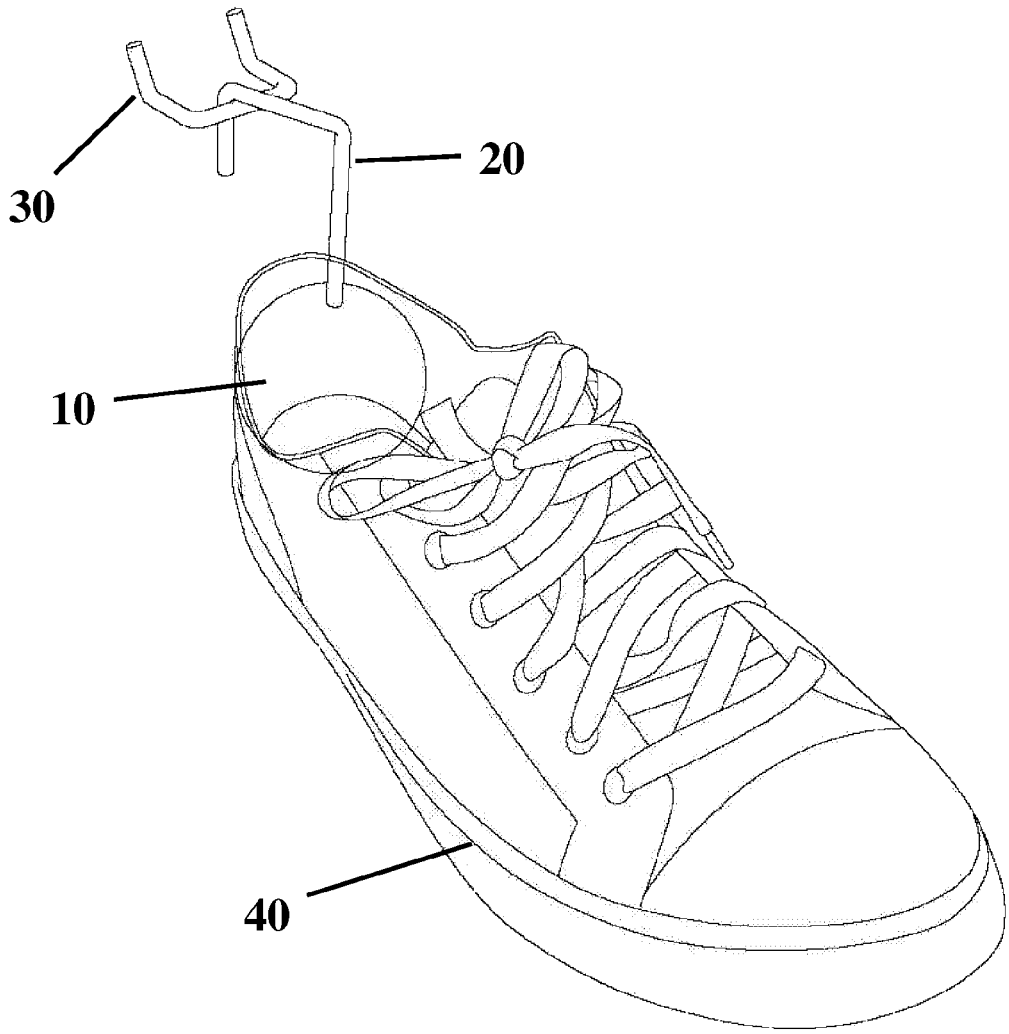
FIG. 2 shows a perspective view of the invention with a shoe supported by it.

FIG. 2 illustrates a perspective view of the invention with a shoe supported by it with a pegboard hanger configuration. The pegboard hanger inserts 30 are inserted into the corresponding holes on the pegboard-style storeboard. The inside portion of the shoe that contacts the wearer's heel is pressed against the storeboard (peg or slat) by pressure from the grip ball 10, or held in place by virtue of the shape of the grip ball 10. The shoe is, in this way, both hung onto the grip ball 10 and pressed against the storeboard. Either one or both support methods (hanging and pressing) can be used with the device. The toe of the shoe faces outward, toward a viewer, providing a clear view of the entire shoe. The device can also be configured with two pegboard hanger stems 20 and grip balls 10. In this embodiment, the hanger stem diverges from one into into a plurality of stem hangers from the original stem with grip balls 10 attached to accommodate both shoes of a pair.

Figure 3:
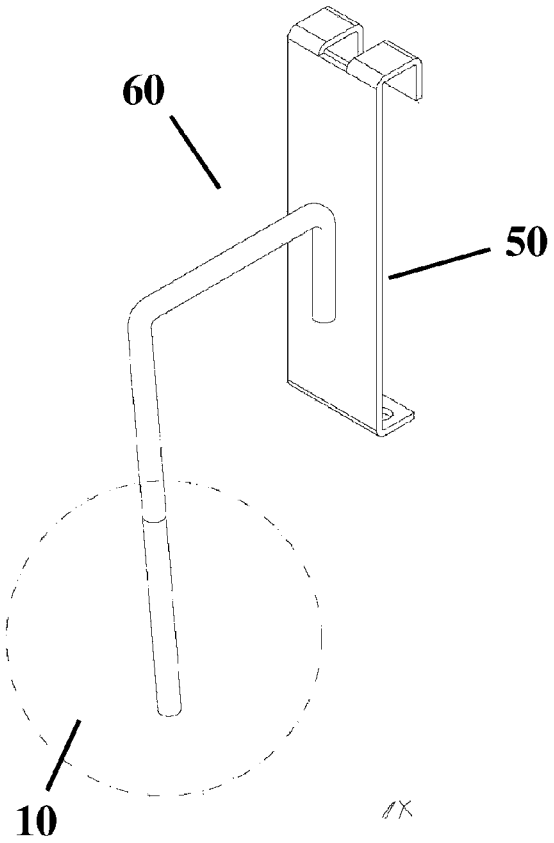
FIG. 3 shows a slatboard embodiment of the invention.

In FIG. 3, the device is shown configured to accept the slatboard-type storeboard 70 embodiment. Consistent with existing and commercially available slatboard backing, the device discloses the hanger which matingly conforms to the slatboard backing. As described and drawn herein, the pegboard hanger stem 20 or the slatboard hanger stem 60 is bent to place the grip ball 10 in proximity to the storeboard 70. Various embodiments of the grip ball 10 can be used; the dotted line in FIG. 3 represents these various embodiments. It is contemplated that the grip ball 10 or other aspects of the device could accommodate logos or other indicia representing sports teams, designers, etc.

Figure 4:
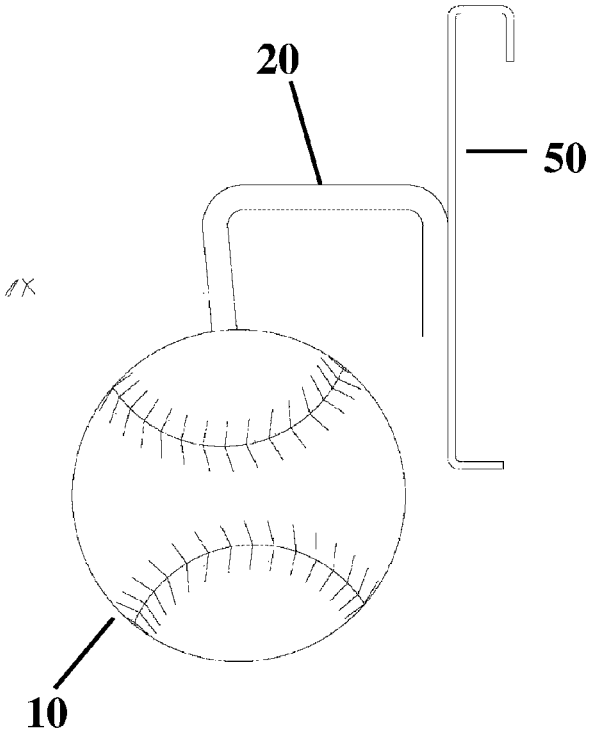
FIG. 4 shows a view of FIG. 3 with a baseball grip ball design.

FIG. 4 shows the device depicted in FIG. 3 including a baseball embodiment. This could be desirable for use with baseball shoes, or for someone who is a baseball fan. The slatboard hanger insert 50 fits into and matingly conforms with commercially available slatboard backing or storeboard 70.

Figure 5:
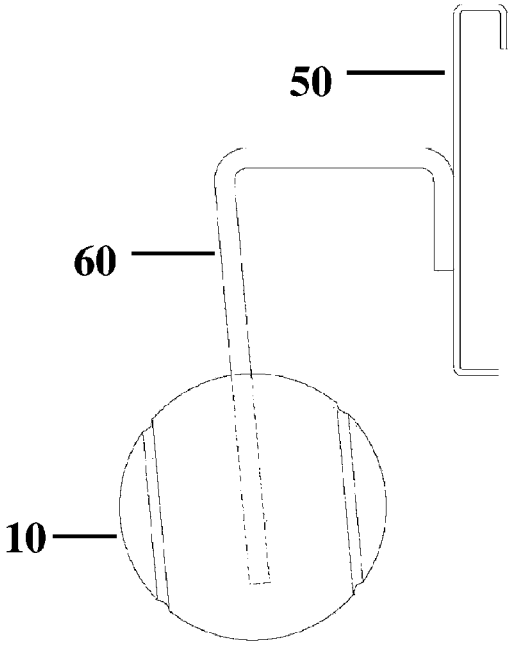
FIG. 5 shows a side view of the slatboard embodiment with a tennis grip ball design.
Figure 6:
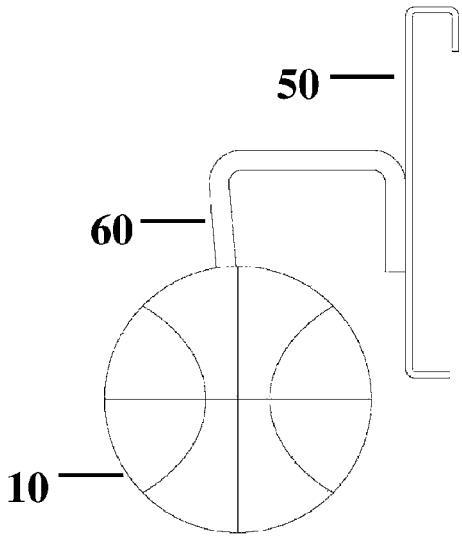
FIG. 6 shows an embodiment of the invention shown in FIG. 5 with a basketball grip ball design.
Figure 7:
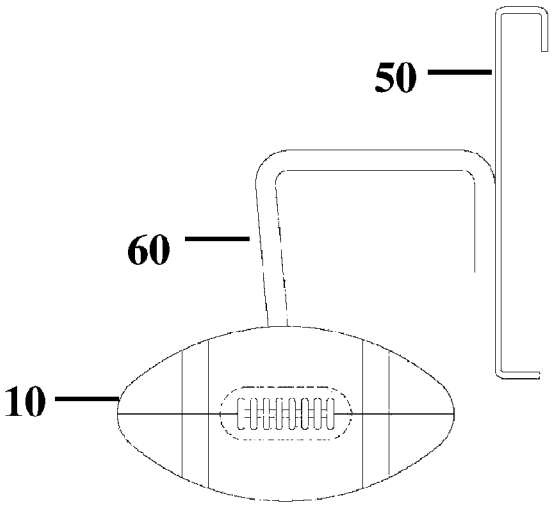
FIG. 7 shows an embodiment of the invention shown in FIG. 5 with a football grip ball design.
Figure 8A:
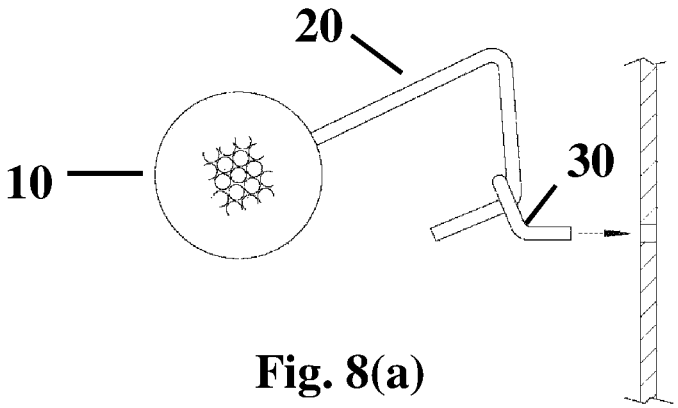
FIGS. 8 (*a-d*) show the invention moving into position to accept and support a shoe.
Figure 8B:
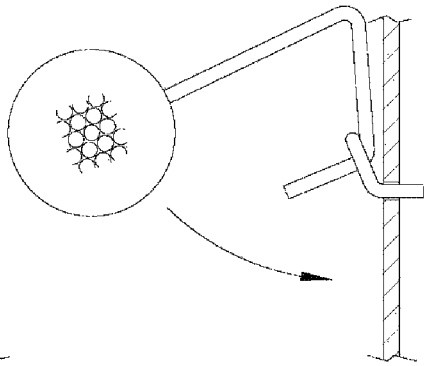
Figure 8C:
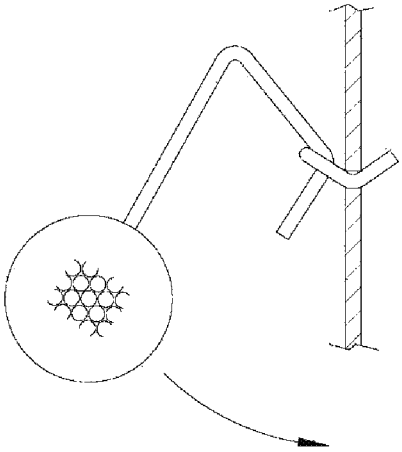
Figure 8D:
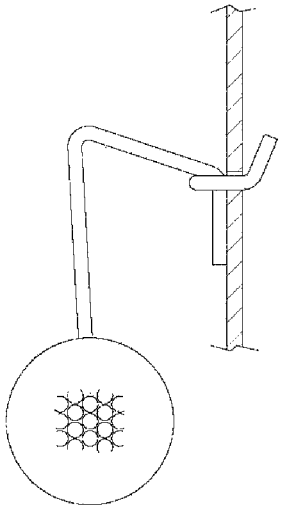

In FIGS. 5-7, the slatboard embodiment is again depicted with various designs of the grip ball 10 represented, including a tennis ball in FIG. 5, a basketball in FIG. 6, and a football in FIG. 7. The grip ball 10 is affixed to the pegboard hanger stem 20 and the slatboard hanger stem 60. The specific angle of the bends in the hanger stems relative to the slatboard hanger insert 50 or the pegboard hanger insert 30 will vary depending upon the type of shoe, hanger material flexibility and size of the grip ball 10.

In FIGS. 8 (*a-d*), the method of the device is shown as it is placed within the storeboard 70. The storeboard 70 may be traditional pegboard or slatboard backing, or other backing of conforming insert dimensions capable of being supported by or attached to a wall, closet or wardrobe. The pegboard hanger insert 30 is sized to engage a pegboard, is generally U-shaped and fits into and conforms with standard pegboards; the hanger insert is attached to, or may be manufactured continuous with, the hanger stem 60. It is inserted into the storeboard 70. Applying pressure to the grip ball 10 causes it to swing downward toward the storeboard 70. The device is inserted from a generally perpendicular disposition relative to the storeboard 70 as in FIG. 8(*a*). It swings downward, as indicated by the arrow in FIG. 8(*b*). This motion continues, as drawn and represented by the arrow in FIG. 8(*c*), and finally rests with the pegboard hangar inserts 30 supported against the storeboard 70 as shown in FIG. 8(*d*). In this way, a shoe can be held by the pressure of the grip ball 10 against the storeboard 70, or can be supported by hanging from the grip ball 10.

Figure 9:
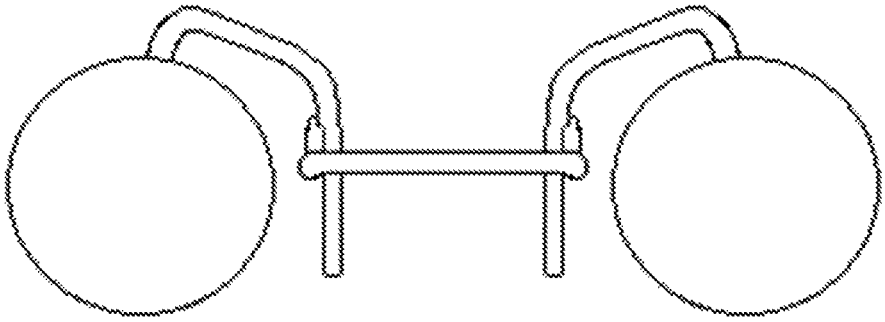
FIG. 9 shows an embodiment of the invention featuring a plurality of grip balls capable of displaying or storing a pair of shoes.

FIG. 9 illustrates an embodiment of the device wherein two shoes can be hung, providing for a pair of shoes to be conveniently displayed or stored. The hanger stem diverges from one into a plurality of stem hangers from the original stem with grip balls 10 attached to accommodate both shoes of a pair.

I claim:

1. An apparatus for horizontal storage and display of shoes comprising:

A. a storeboard backing capable of being supported by or attached to a wall, closet or wardrobe; said storeboard backing further comprises pegboard with dimensions matingly conforming to one or more hanger inserts of the apparatus, capable of receiving and supporting said hanger inserts;

B. the one or more hanger inserts removeably connected to said storeboard backing, said hanger insert is sized to engage the pegboard, is U-shaped and fits into and conforms with the pegboard; said hanger insert is attached to or continuous with one or more hanger stems;

C. the one or more hanger stems with one or more bends, angles, or directional returns, wherein said bends, angles or directional returns in the hanger stem position one or more shoes hung on one or more grip balls in proximity to the storeboard backing sufficiently to press or to support a portion of a shoe occupied by a wearer's heel and maintain the shoe facing outwards at a ninety (90) degree angle relative to the storeboard backing;

D. the one or more grip balls capable of supporting horizontally disposed shoes for storage or display, wherein the one or more grip balls are larger than an end of the hanger stem and sized to fit inside of one or more shoes, and are decorated, ornamented or designed with sports or other specialty insignia or indicia corresponding to a particular shoe type or brand that is to be displayed or stored upon it.

2. An apparatus for horizontal storage and display of shoes comprising:

A. a storeboard backing capable of being supported by or attached to a wall, closet or wardrobe; said storeboard backing further comprises slatboard with dimensions matingly conforming to one or more hanger inserts of the apparatus, capable of receiving and supporting the hanger inserts;

B. the one or more hanger inserts removeably connected to said storeboard backing, said hanger insert is sized to engage the slatboard, and fits into and conforms with the slatboard; said hanger insert is attached to or continuous with one or more hanger stems;

C. the one or more hanger stems with one or more bends, angles, or directional returns, wherein said bends, angles or directional returns in the hanger stem position a shoe hung on one or more grip balls in proximity to the storeboard backing sufficiently to press or to support a portion of a shoe occupied by a wearer's heel and maintain the shoe facing outwards at a ninety (90) degree angle relative to the storeboard backing;

D. the one or more grip balls capable of supporting horizontally disposed shoes for storage or display, wherein the one or more grip balls are larger than an end of the hanger stem and sized to fit inside of one or more shoes, and are decorated, ornamented or designed with sports or other specialty insignia or indicia corresponding to a particular shoe type or brand that is to be displayed or stored upon it.

3. The apparatus of claim 1 or claim 2 wherein the hanger stem diverges into a pair of the grip balls capable of storing or displaying a pair of shoes.

4. A method for horizontal storage and display of shoes comprising the steps of:

A. Providing an apparatus for horizontal storage and display of shoes comprising:

i. a storeboard backing capable of being supported by or attached to a wall, closet or wardrobe; said storeboard backing further comprises pegboard or slatboard with dimensions matingly conforming to one or more hanger inserts of the apparatus, capable of receiving and supporting said hanger inserts;

ii. the one or more hanger inserts removeably connected to said storeboard backing, wherein said hanger insert is sized to engage the pegboard or slatboard and fits into and conforms with the pegboard or slatboard; said hanger insert is attached to or continuous with one or more hanger stems;

iii. the one or more hanger stems with one or more bends, angles, or directional returns, wherein said bends, angles or directional returns in the hanger stem position a shoe hung on one or more grip balls in proximity to the storeboard backing sufficiently to press or to support a portion of a shoe occupied by a wearer's heel and maintain the shoe facing outwards at a ninety (90) degree angle relative to the storeboarding backing;

iv. the one or more grip balls capable of supporting horizontally disposed shoes for storage or display, wherein the one or more grip balls are larger than an end of the hanger stem and sized to fit inside of one or more shoes, and are decorated, ornamented or designed with sports or other specialty insignia or indicia. corresponding to a particular shoe type or brand that is to be displayed or stored upon it;

B. inserting the hanger insert into the storeboard backing to connect the hanger insert with the storeboard backing;

C. removeably positioning one or more shoes upon one or more said grip balls;

D. applying pressure to engage said grip ball or balls with the portion of one or more shoes which is to be occupied by a wearer's heel, and pressing said grip ball or balls against said portion of the one or more shoes which is to be occupied by a wearer's heel until it contacts the storeboard backing;

E. removing or replacing the one or more shoes as desired to store or display at a user's preference.

* * * * *